US008870096B2

(12) United States Patent
Masson

(10) Patent No.: US 8,870,096 B2
(45) Date of Patent: Oct. 28, 2014

(54) PNEUMATIC TOOL FOR BLOWING

(76) Inventor: Lucien Masson, Maur (CH)

( * ) Notice: Subject to any disclaimer, the term of this patent is extended or adjusted under 35 U.S.C. 154(b) by 542 days.

(21) Appl. No.: 13/247,928

(22) Filed: Sep. 28, 2011

(65) Prior Publication Data

US 2012/0248223 A1 Oct. 4, 2012

(30) Foreign Application Priority Data

Sep. 28, 2010 (DE) ..... 10 2010 046 710

(51) Int. Cl.

| | |
|---|---|
| ***B05B 7/02*** | (2006.01) |
| ***B08B 5/02*** | (2006.01) |
| ***B05B 1/00*** | (2006.01) |
| ***B05B 15/06*** | (2006.01) |

(52) U.S. Cl.

CPC . *B05B 1/005* (2013.01); *B08B 5/02* (2013.01); *B05B 15/066* (2013.01)

USPC ..... 239/525; 239/526

(58) Field of Classification Search

CPC ..... B05B 7/02; B05B 9/01

USPC ..... 239/525, 526, 527, 530, 602

See application file for complete search history.

(56) References Cited

U.S. PATENT DOCUMENTS

| | | | | |
|---|---|---|---|---|
| 703,103 | A | 6/1902 | Weber | |
| 6,123,237 | A | 9/2000 | Lasserre et al. | |
| 6,371,385 | B1 * | 4/2002 | Schiller et al. | 239/310 |
| 6,752,335 | B2 * | 6/2004 | Levia | 239/587.3 |
| 7,549,448 | B2 * | 6/2009 | Ragner | 138/119 |
| 2006/0022069 | A1 | 2/2006 | Burnworth et al. | |
| 2006/0283981 | A1 * | 12/2006 | Mead et al. | 239/526 |

FOREIGN PATENT DOCUMENTS

| | | |
|---|---|---|
| DE | 19928418 A1 | 12/2000 |
| WO | 8101668 | 6/1981 |
| WO | 83/01748 | 5/1983 |

OTHER PUBLICATIONS

Search report from the German Patent and Trademark Office dated Jul. 18, 2011.

Search report from the European Patent Office dated May 30, 2012 (English translations provided on pp. 5 and 7).

* cited by examiner

*Primary Examiner* — Davis Hwu

(74) *Attorney, Agent, or Firm* — The Maxham Firm

(57) ABSTRACT

A pneumatic tool as an integral plastic part for blowing, the tool having a connecting nipple with a rigid connecting part for supplying a pressure medium, and a blow head with at least one nozzle opening for targeted release of the pressure medium. A flexibly deformable bending part is attached to the rigid connecting part with the associated connecting nipple. A non-bendable rigid upper part with the blow head is attached to the deformable bending part. Also included is a valve rod for the pneumatic tool, wherein the valve rod is formed as a pulling tool for pulling out and for reinserting an internal seal.

10 Claims, 4 Drawing Sheets

PNEUMATIC TOOL FOR BLOWING

FIELD OF THE INVENTION

This invention relates generally to a pneumatic tool for blowing, and more particularly such a tool that is easier to use and has reduced air movement noises.

BACKGROUND

With German patent publication 199 28 418 A1, a pneumatic tool of the same general type is known which consists substantially of three pieces. At a lower screw-in nipple, a non-bendable part is attached which transitions in its upper region into a bending part at which finally the blow-out nozzle is arranged. Here, a valve rod is arranged in a central channel and abuts with its upper free end in the region of the bending part.

The actuation of the pneumatic tool takes place in such a manner that the thumb has to engage at the upper bending part so as to elastically move the bending part by thumb pressure, thereby tilting the valve to cause the valve disk arranged at the other end of the valve rod to lift off its valve seat.

However, a disadvantage of the previous pneumatic tool is that a relatively high thumb force was necessary. The basal thumb joint is heavily stressed during repeated and long usage. A result is that it frequently caused tenosynovitises.

Another prior art device having similar drawbacks is revealed in WO 83/01748 A1 wherein, likewise, a bending part is attached to a rigid lower part in which also a screw-in nipple is arranged. The valve rod is held in an upper holder which is arranged at the upper end of the bending part. Here too, the deformation of the upper part has to be achieved with the thumb by strong thumb pressure which entails the risk of damage to the basal thumb joint and to the associated tendons.

SUMMARY OF EMBODIMENTS OF THE INVENTION

It is a purpose of embodiments of the present invention to provide a pneumatic tool of the aforementioned general type in such a manner that it can be actuated with low finger force, with resultant protection of the actuating hand and the associated phalanges.

It is a feature of embodiments of the invention that to a rigid connecting part on which a connecting nipple is arranged, a flexibly deformable (and thus bendable) bending part is attached to which, in turn, a non-bendable upper part is attached on which finally the blow head with one or a plurality of blow-off openings or nozzle openings is arranged.

The given technical teaching offers the advantage that the bending part is not arranged at the top near the blow head but closer to the bottom, near the rigid connecting part on which the connecting nipple is arranged. Thus, the bending part is arranged in the region of the last four fingers which grasp around the handle and no longer, as in case of the prior art, in the region of the thumb of the actuating hand. This results in the advantage of a five-finger actuation which means that with the four fingers of the right hand (or the left hand), a counter force is exerted on the lower part of the pneumatic tool and a bending force is exerted with the thumb of the same hand on the upper, non-bendable part of the pneumatic tool. Due to the forces of the four fingers counteracting each other, compared to the thumb of the same hand, a leverage is applied to the non-bendable upper part, which leverage is transferred to the bending part arranged near the connecting part so that the bending part can be bent with a large leverage force.

Thus, with a relatively low finger force which results in protection of the finger joints and the associated tendons, it is possible for the first time to exert a large bending force on the pneumatic tool without the finger joints and the thumb joint being highly stressed. Due to the provided leverage force it is now possible to use the four fingers as counterholder as well as the thumb as the actual power source against each other whereby a particularly easy bending takes place because according to the invention as described, the bending part is now arranged in the lower region of the pneumatic tool and no longer in the upper region as it is the case in the prior art.

In another mode of operation for actuating the pneumatic tool according to the invention, it can even be provided that the thumb itself acts only as a counterholder and rests against the non-bendable upper part while the four fingers of the same hand exert a corresponding inwardly directed pressure toward the palm and thus bend the bending part about its longitudinal axis at an angle so as to bring the valve rod in the interior of the pneumatic tool into a tilt position and thus to let the valve disk lift off the valve seat.

This is a new way of actuation because, according to the invention, the bending part is now in the region of the four fingers and no longer in the region of the thumb as it is shown in the above-identified prior art.

In a preferred configuration of the invention it is provided that the entire pneumatic tool consists of a plastic part made from a unitary material which is integrally injection-molded in an injection molding tool in one production step, wherein the entire plastic material of the pneumatic tool consist of a uniform plastic. Thereby, the advantage is achieved that with a single injection molding tool and a single plastic material, a non-bendable upper part as well as a bending part is produced.

In a further embodiment of the bending part according to the invention it is provided that the latter consists of a number of annular ribs which are arranged spaced apart from each other and aligned parallel to each other and have a first outer diameter, wherein the ribs are alternately arranged with corresponding annular grooves. This means that in each case one annular groove follows one rib, and the annular groove has an outer diameter which is reduced with respect to the diameter of the adjacent ribs.

Thus, the bending part as a ribbed part is configured in a bendable manner in that the annular grooves have a relatively small diameter and therefore make the plastic material bendable whereas the ribs, as such, are not formed bendable. Accordingly, the bending part is configured in a bendable manner by the core of the groove bottom of the annular grooves. Bending takes place because the diameter of the bottom of the annular groove and thus the material thickness of the plastic is significantly smaller compared to the outer diameter of the pneumatic tool. Thus, this involves a material-weakened cross-section of the body of the pneumatic tool in the region of the bending part. Thereby, a part with a reduced material cross-section is formed whereby the bendability of the bending part is achieved.

In a further advantageous embodiment of the invention it is provided to achieve the bendability of the bending part by another constructional configuration. Instead of a continuously material-weakened cross-section of the plastic material in the region of the bending part it can be provided to configure the cross-section of the plastic in this region equal to the cross-section of the plastic in the other, non-bendable regions. However, in this case, recesses, grooves, splines or the like weakening the cross-section are to be provided in the region of the bendable part so as to achieve the bendability.

Furthermore, in a third embodiment it can be provided to configure the material of the plastic in the region of the bendable part softer and more elastic compared to remaining non-bendable regions.

Due to the fact that the entire pneumatic tool, including the bending part, is formed as a unitary single piece from, for example, a relatively rigid elastomeric plastic, there is no risk that any individual parts can fall off the pneumatic tool or break or become leaky, as may be the case, for example, with respect to the subject matter of WO 83/01748 A1.

Tests have shown that an essential error source of such pneumatic tools lies substantially in the seal which interacts with the valve disk and the associated valve rod. For this reason, the present invention provides easy replaceability of the seal which interacts with the valve disk and the valve rod. This is achieved by a particular shape of the valve rod which, at the same time, is configured as pulling tool for pulling the seal out of the connecting part.

For this purpose the valve rod consists of two parts, namely an upper part with a larger diameter which transitions via an annular limit stop into a lower part with a smaller diameter in the region of which a further annular insert is arranged, on the outer diameter of which a further annular shoulder is arranged which has a crowned shape on its outer circumference. The entire valve rod is, of course, integrally formed from a suitable, preferably metal material, and can be fabricated by known means, such as by turning.

According to the invention, this valve rod is configured at the same time as the pulling tool for pulling out the seal. For replacing this seal, the connecting part of the pneumatic tool is struck at the bottom against a suitable abutment surface in such a manner that the valve rod is driven downwardly, for example, by gravity and thereby the lower annular shoulder on the lower part slips with its crowned surface through the seal to be replaced and reaches the other side of that seal.

Thus, the valve disk of the valve rod then protrudes downwardly from the connecting part and can be grasped with the hand, whereby by further pulling the valve rod, the upper annular limit stop abuts against the seal to be replaced. By further pulling the valve rod, the upper limit stop, because it is formed as annular limit stop, drives the seal downwardly out of the connecting nipple and the seal can be easily removed. Thus, the seal is configured in an easily replaceable manner and by a reversed process, as described above, the replacement seal can be inserted. Thus, the valve rod is formed at the same time as pulling tool for replacing the seal for the valve disk.

When removing the valve rod, the entire air-conveying channel, including blow-off openings in the blow head, is freely accessible and can be cleaned with a suitable cleaning liquid or with compressed air.

Another advantage of the configuration of the body of the pneumatic tool from an elastomeric plastic, which is unitarily formed, is that it is now possible for the first time to design a blow head with a plurality of blow-off openings (nozzles) uniformly distributed over the circumference. Thus, a relatively large air flow of low noise level can be output without generating sibilating or whistling noises as often is the case in single-nozzle arrangements. This can be achieved because, according to the invention embodiments described, a number of blow-off openings are uniformly distributed over the circumference and each blow-off opening is arranged in the region of a sector chamber. Each sector chamber is bounded by ribs which are arranged radially and uniformly distributed on the circumference, wherein a blow-off opening aligned in the longitudinal direction is arranged at the bottom of each sector chamber.

Due to the blow-off flow which is generated through the blow-off opening, air is sucked in the region of each sector chamber for each individual blow-off opening, whereby turbulences in the region of the blow head are avoided and thus a significantly reduced blowing noise is the case.

BRIEF DESCRIPTION OF THE DRAWING

Advantages, features, and purposes of the invention will be readily perceived from the following detailed description, when read in conjunction with the accompanying drawing, wherein.

DETAILED DESCRIPTION OF EMBODIMENTS OF THE INVENTION

Figure 1:
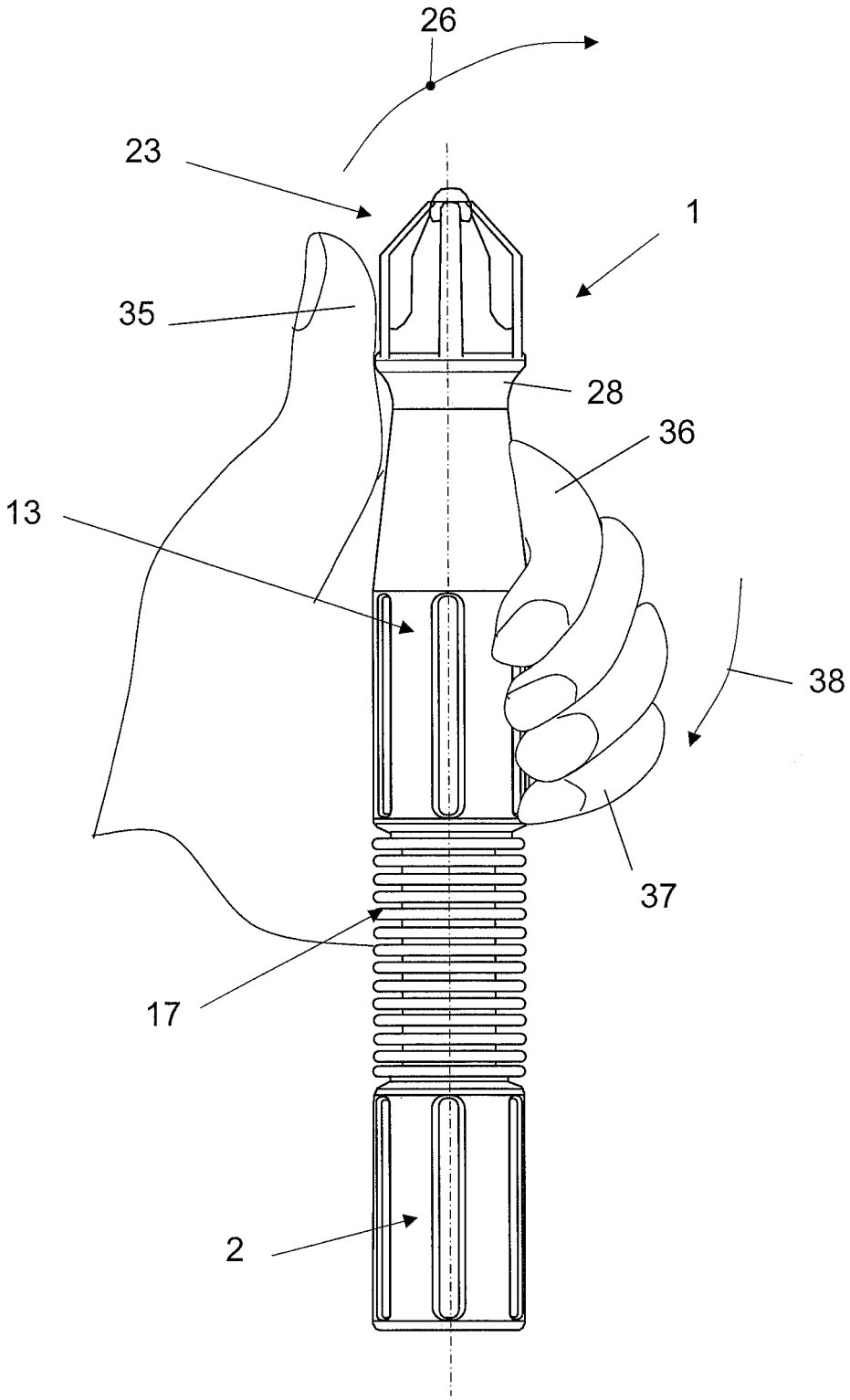
FIG. 1 schematically shows a side view of a pneumatic tool actuated by a hand according to an embodiment of the present invention.

With reference now to the drawing, FIG. 1 illustrates an embodiment of the new structure according to the invention of pneumatic tool 1, wherein it is assumed in the exemplary embodiment that the pneumatic tool is actuated with the fingers of the left hand. Of course, an actuation is also possible with the right hand.

Bending part 17 is attached to connecting part 2, in which normally connecting nipple 3 (see FIGS. 2 and 3) is arranged. This structure ensures the bendability of the entire body of the pneumatic tool.

To bending part 17 rigid upper part 13 is attached which, accordingly, is not bendable and transitions integrally into blow head 23 in which a series of nozzle openings 25 is arranged uniformly distributed over the circumference.

It is important that with the fingers of the left hand, wherein only index finger 36 and little finger 37 are designated by numbers, pressure is exerted in the direction of arrow 38 on the body of the pneumatic tool with respect to connecting part 2 which is connected to a source of pressurized air (not shown) and, with thumb 35 of the same hand, pressure is exerted in the direction of the arrow 26 on the non-bendable upper part 13.

Because the fingers of the hand hold the lower part, bending of pneumatic tool 1 at an angle about its longitudinal axis takes place in the region of bending part 17, wherein the two force directions of thumb 35 in the lateral direction of arrow 26 and of the fingers in the direction of arrow 38 are directed against each other. This results in a leverage effect and therefore in a good bendability of the entire pneumatic tool with relatively low thumb and finger force. When lateral force 26 is released, the tool returns to its normal generally straight linear condition.

Because only little finger force is required, the respective finger joints and the associated tendons are only insignificantly stressed. This is an advantage over the prior art because in case of the prior art, tenosynovitises were very common for multiple and repeated actuations. The embodiments of the invention shown here avoids this stress through the particular arrangement that to the rigid, non-bendable connecting part 2, bending part 17 is directly attached to which, in turn, non-bendable upper part 13 and blow head 23 are attached.

Figure 2:
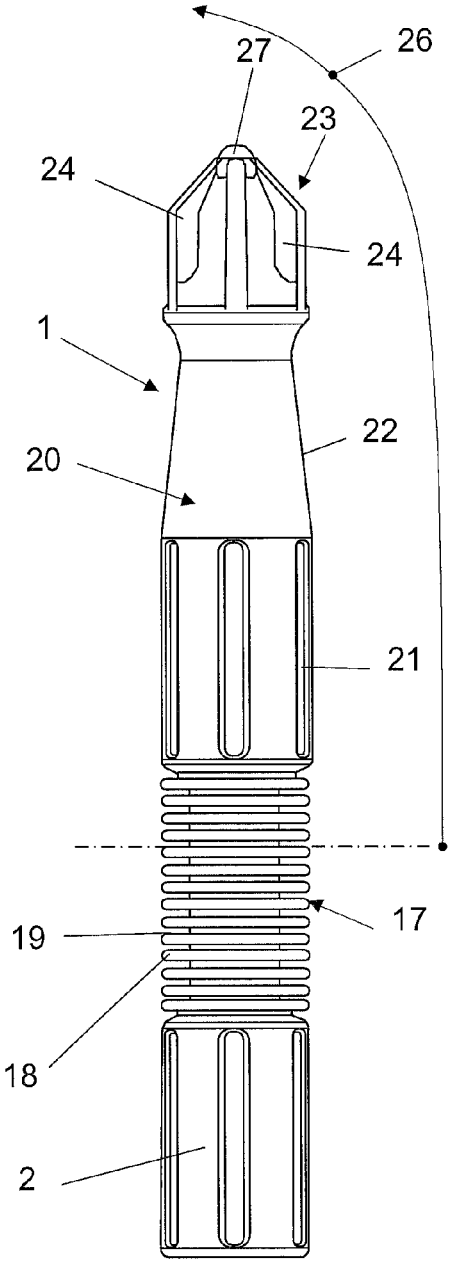
FIG. 2 shows the pneumatic tool according to FIG. 1 with an illustration of further details.
Figure 3:
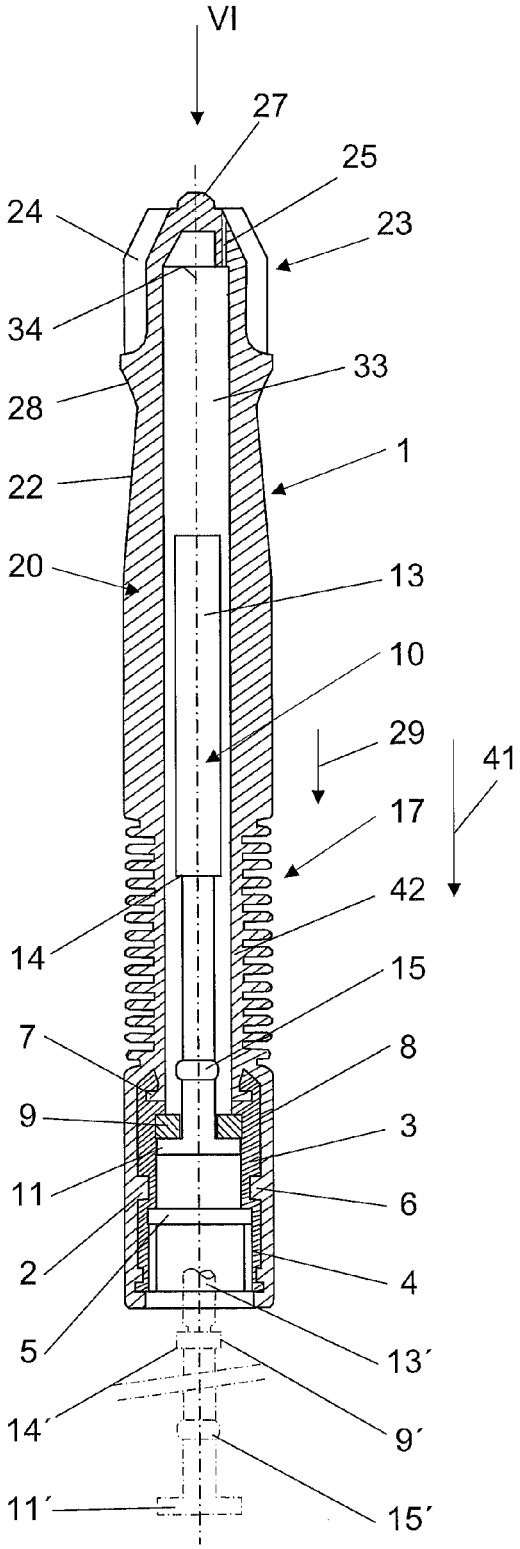
FIG. 3 shows a section through the pneumatic tool according to FIGS. 1 and 2 with two different functional positions of the valve rod.

Further details of embodiments of the present invention are shown in FIGS. 2 and 3. In rigid connecting part 2, which is integrally connected to the remaining tool body of the pneumatic tool, connecting nipple 3 is injection-molded. The latter has a number of depressions or grooves 6 and 7 by means of which the nipple is embedded in a non-rotatable manner in connecting part 2. Of course, the grooves of nipples 3 and mating ribs of connecting part 2 could be reversed.

Connecting nipple 3 preferably consists of a high-strength metal material and has an undercut 5 at the thread runout. Accordingly, threaded receptacle 4 for screwing in a connection thread from a compressed air source (not shown) is formed.

In the region of connecting nipple 3, upper annular groove 8 is provided in which replaceable seal 9 is seated. Valve disk 11, which is part of valve rod 10 (shown in detail in FIG. 4), rests against the lower side of seal 9. A portion of valve disk 11 is illustrated in FIG. 5 and has upper recess 30 which abuts against seal 9 wherein, radially outwardly, annular cone 31 is arranged so as to prevent damage to the wall of connecting nipple 3 during the tilting of valve disk 11.

Figure 4:
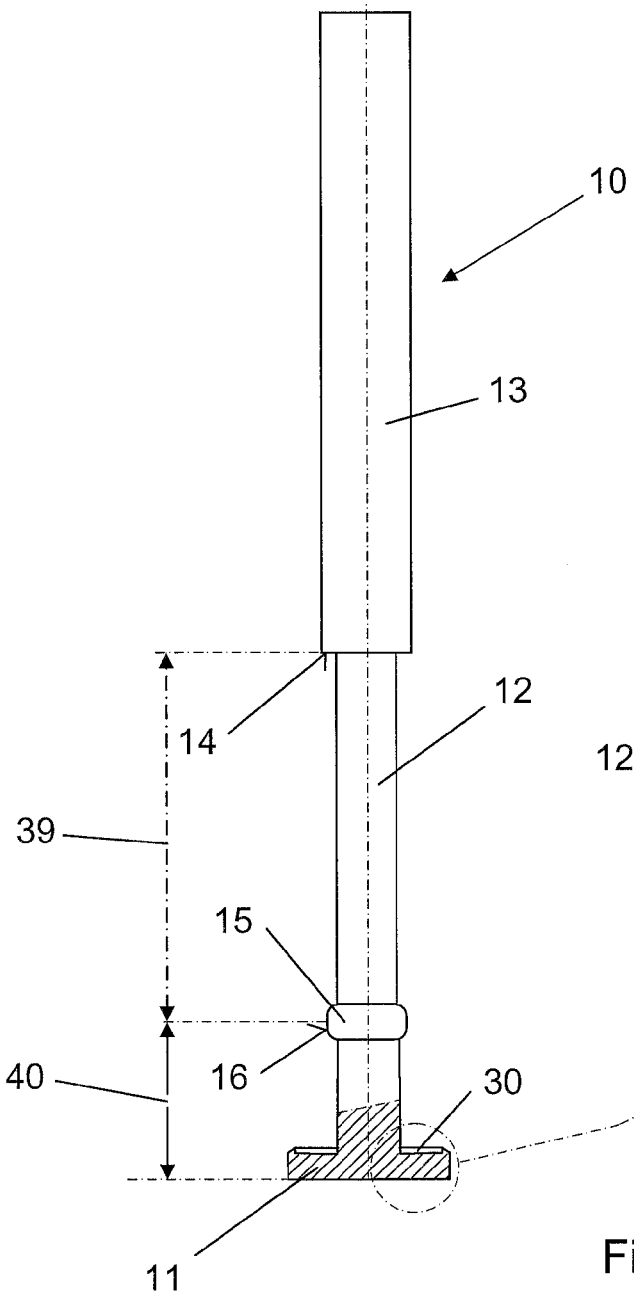
FIG. 4 shows the valve rod of the pneumatic tool according to FIG. 3.
Figure 5:
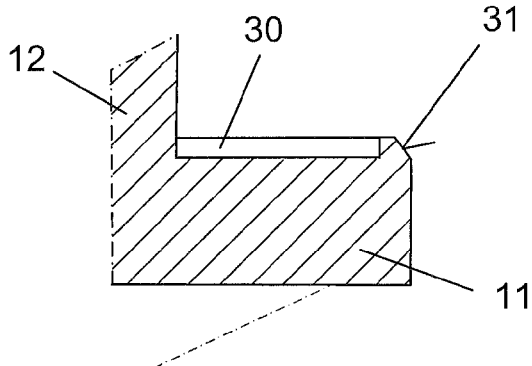
FIG. 5 shows an enlarged partial section through a detail at the valve disk of the valve rod of FIG. 4.

According to FIG. 4, valve rod 10 consists of valve disk 11, wherein the latter is integrally engaged with lower part 12 which has a reduced diameter. In the region of lower part 12, annular shoulder 15 with enlarged diameter is formed which carries crown 16 on the outer circumference.

At a distance 39 from annular shoulder 15, lower part 12 extends with the same diameter and transitions into an upper part 13 with enlarged diameter thereby forming annular limit stop 14. In the other direction, between annular shoulder 15 and valve disk 11, is a distance 40 of the valve rod.

For replacing seal 9, an illustration of the function is represented by dashed lines in FIG. 3, showing how valve rod 10 works as a pulling tool for pulling out seal 9. For this purpose it is provided that pneumatic tool 1 is sharply struck in the direction of arrow 41 against an abutment surface so that annular shoulder 15 slides, gravity-driven with its crown 16, through the central opening of seal 9 and reaches a position as shown in the dashed lines in FIG. 3.

As shown, valve disk 11 protrudes to position 11' out of the bottom of connecting nipple 3 and can be pulled downwardly by finger force, whereby limit stop 14 abuts against the upper side of seal 9. Pursuant to further pulling valve disk 11 and with lower part 12 of valve rod 10 protruding out of nipple 3, limit stop 14 pushes on the upper side of seal 9 and the entire seal is detached from groove 8 and is pulled out downwardly together with valve rod 10. Thus, seal 9 is easily replaceable.

For inserting a new seal, the seal can simply be placed onto upper part 13 of the valve rod and can be stretched to enable it to pass over upper part 13 and come to rest on reduced diameter lower part 12. Then, the reversed assembly path takes place in the opposite direction with respect to arrow 41, whereby when pushing into tool 1 valve rod 10, valve disk 11 moves seal 9 upwardly until it comes to rest again in groove 8.

Therefore, it is shown that valve rod 10 has a dual function, namely, on the one hand, when tilted, to actuate the pneumatic tool with valve disk 11 and seal 9 and, on the other, to serve also as a pulling tool by means of which seal 9 can be quickly replaced and assembled again.

Apart from that, when removing the valve rod, the entire air-conveying channel 33 becomes freely accessible and can be cleaned with suitable cleaning means or with compressed air, including openings 25 in the region of blow head 23.

The bendability of the bending part 17 is established in that it consists of the same, generally non-bendable material of pneumatic tool 1, but that ribs 18, which are uniformly distributed over the circumference and spaced apart from each other, alternate with annular grooves 19. Groove bottom 42 forms a material-weakened shaft and the tool is therefore easily bendable. In this manner, any bending in the region of the bending part 17 can take place, for example in the direction of arrow 26, as it is illustrated in FIGS. 1 and 2.

Upper part 20 of the tool is integrally attached to bending part 17, whereby the upper part receives with its channel 33, upper part 13 of valve rod 10. Upper part 20 transitions in its upper region into conical part 22 which, by forming a cone shoulder 28, transitions into blow head 23. In the region of the upper part 20 and also in the region of the connecting part 2, gripping grooves 21 can be arranged.

Figure 6:
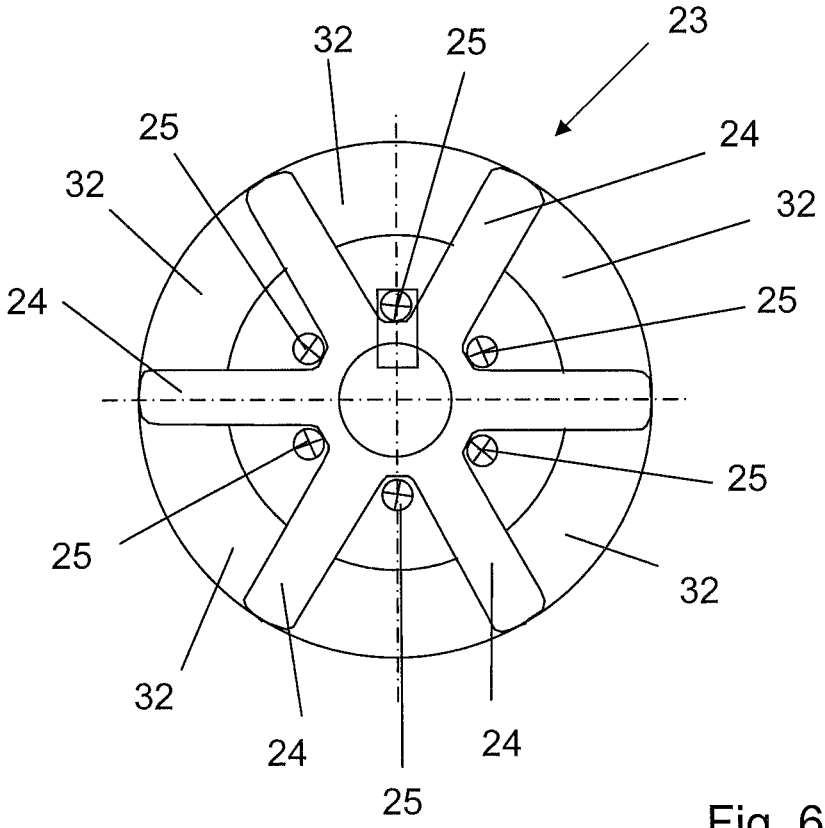
FIG. 6 shows the front view of on the pneumatic tool in the direction of the arrow VI in FIG. 3.

According to FIG. 6, blow head 23 consists of a number of longitudinal ribs 24 uniformly distributed over the circumference, the longitudinal ribs forming a sector chamber 32 between each two ribs. At the bottom of each sector chamber 32, nozzle opening 25 is arranged which is aligned in the longitudinal direction.

By forming sector chambers 32 which are separated from each other by longitudinal ribs 24 it is ensured that the nozzle flow upwardly output in the longitudinal direction from blow head 23 of each nozzle opening 25 is replaced by sucked-in air which is also upwardly sucked in the longitudinal direction in sector chamber 32. In this manner, a separate air flow is subsequently sucked in for each nozzle opening in each sector chamber 32, whereby an undesired turbulence of the air flow and therefore undesired loud blowing noises are avoided.

Apart from that, the arrangement of sector chambers 32 with the longitudinal ribs 24 provides that due to nozzle openings 25 arranged hidden or recessed in this manner in the sector chambers it is not possible to attach the blow head 23 directly onto a body part because the longitudinal ribs 24 act as spacers.

Apart from that, at the upper side of the body of the pneumatic tool 1, limit stop 27 is arranged which is formed hemispherically as a tip.

In the interior of channel 33, all of the nozzle openings 25 run via straightly formed front end 34 of channel 33 into blow head 23.

Tests have shown that due to the installation situation according to the invention, bending the bending part 17 is even made easier if compressed air flows through the pneumatic tool 1. Bending the bending part 17 is made easier approximately by the factor ⅓ if compressed air flows through compared to bending the bending part 17 without the flow of compressed air.

For illustration purposes, the installation situation according to the FIGS. 3 and 4 is further discussed. By way of example, the larger diameter of upper part 13 of valve rod 10 is about 6 mm and the diameter of the smaller valve part 12 is about 4 mm. The inner diameter of channel 33 is about 8 mm. Thus, annular limit stop 14 has a radial annulus of about 2 mm. When compressed air flows and impinges with high speed on limit stop 14, the latter forms a barrier in the compressed air flow and thus a tensile force is created acting upwardly on the valve rod in the direction of its longitudinal axis. Thus, the valve seat between valve disk 11 and seal 9 is compacted. On the other hand, the compressed air flows with high speed through the narrow annular channel between the outer circumference of upper part 13 and the inner circumference of channel 33. The flow forces generated thereby result in that bending the bending part 17 can be carried out with significantly lower force if compressed air is flowing than it is the case if compressed air is not flowing.

What is claimed is:

1. An elongated pneumatic tool for blowing, the tool having an interior and a longitudinal axis and comprising:

a connecting nipple with a connecting part for connecting the tool to a supply of a pressure medium;

a blow head with at least one nozzle opening for targeted release of the pressure medium;

a flexibly deformable bending part attached to a rigid connecting part with the associated connecting nipple;

a non-bendable, rigid upper part with the blow head attached to said flexibly deformable bending part; and a valve rod having a valve disk thereon in the interior of the pneumatic tool which, by exerting lateral pressure on the bending part, can be brought in a tilt position and thus lifts the valve disk off a seal in the tool interior.

2. The pneumatic tool according to claim 1, wherein the bending, part is arranged near the pressure connection in a lower region of the pneumatic tool.

3. The pneumatic tool according to claim 1, wherein the entire pneumatic tool consists of an integral part made of a relatively rigid elastomeric plastic.

4. The pneumatic tool according to claim 1, wherein the bending part consists of a number of annular ribs which are arranged spaced apart from each other and are aligned parallel to each other, and of annular grooves, wherein the ribs are arranged alternating with the corresponding annular grooves and the annular grooves have a reduced outer diameter with respect to the diameter of the ribs.

5. The pneumatic tool according to claim 1, wherein the bending part consists of a number of annular ribs which are arranged spaced apart from each other and are aligned parallel to each other, and of annular grooves, wherein the ribs are arranged alternating with the corresponding annular grooves and the annular grooves have a reduced outer diameter with respect to the diameter of the ribs.

6. The pneumatic tool according to claim 1, wherein the connecting part, the bending part, and the upper part with the blow head have an identical cross-section, wherein in the region of the bending part, weakening recesses such as grooves, splines or the like are formed.

7. An elongated pneumatic tool for blowing, the tool having an interior and a longitudinal axis and comprising:

a connecting nipple with a connecting part for connecting the tool to a supply of a pressure medium;

a blow head with at least one nozzle opening for targeted release of the pressure medium, the blow head being formed with a plurality of nozzle openings which are arranged uniformly distributed over a circumference of the blow head and each nozzle opening is arranged in an area of a sector chamber, wherein each sector chamber is bounded by ribs which are radially and uniformly arranged over the blow head circumference, and at a bottom of each sector chamber a nozzle opening is arranged which is aligned in the direction of the longitudinal axis;

a flexibly deformable bending part attached to a rigid connecting part with the associated connecting nipple; and a non-bendable, rigid upper part with the blow head attached to said flexibly deformable bending part.

8. The pneumatic tool according to claim 1, wherein the valve rod is formed as a pulling tool for pulling out an internal seal and as an opposite direction motion, the valve rod is formed as a pulling tool for seating an internal seal within the tool.

9. The pneumatic tool according to claim 8, wherein the valve rod is formed from at least two parts and comprises of an upper part and a lower part, the upper part having a first diameter which transitions via an annular limit stop into the lower part having a second, smaller diameter which, in the lower region of the lower part, has a crowned annular shoulder on the outer circumference to which a region with the same diameter as the lower part is attached and subsequently transitions into the valve disk with a diameter larger than the second diameter.

10. A method for assembling and disassembling a seal of an elongated pneumatic tool having an interior and a longitudinal axis, a connecting nipple with a connecting part for connecting the tool to a supply of a pressure medium, a blow head with at least one nozzle opening for targeted release of the pressure medium, a flexibly deformable bending part attached to a rigid connecting part with the associated connecting nipple, a non-bendable, rigid upper part with the blow head attached to said flexibly deformable bending part, and a valve rod having a valve disk thereon in the interior of the pneumatic tool which, live exerting lateral pressure on the bending part, can be brought in a tilt position and thus lifts the valve disk off a seal in the tool interior, the method being accomplished by:

striking a connecting part of the pneumatic tool at one end onto a suitable abutment surface, thereby downwardly driving the valve rod by gravity and weight toward the connecting part;

sliding a lower part of the valve rod having a crowned annular shoulder thereon completely through the connecting part and through the seal to be replaced;

grasping the valve disk of the valve rod and pulling the valve rod downwardly out of the pneumatic tool, the valve rod having an upper annular limit stop whereby the upper annular limit stop abuts against the seal to be replaced; and driving the seal downwardly out of the connecting part due to a further pulling movement whereby the upper annular limit stop acts on and dislodges the seal.

* * * * *